US010692672B2

(12) United States Patent
Ma et al.

(10) Patent No.: US 10,692,672 B2
(45) Date of Patent: Jun. 23, 2020

(54) DC VACUUM INTERRUPTER WITH MULTI-POLAR TRANSVERSE PERMANENT MAGNETIC STRUCTURE

(71) Applicant: XI'AN JIAOTONG UNIVERSITY, Xi'an, Shaanxi (CN)

(72) Inventors: Hui Ma, Shaanxi (CN); Zhiyuan Liu, Shaanxi (CN); Jianhua Wang, Shaanxi (CN); Yingsan Geng, Shaanxi (CN); Xiuli Yi, Shaanxi (CN); Xiangwen Xiao, Shaanxi (CN); Jinyu Shen, Shaanxi (CN)

(73) Assignee: XI'AN JIAOTONG UNIVERSITY, Xi'an, Shaanxi (CN)

( * ) Notice: Subject to any disclaimer, the term of this patent is extended or adjusted under 35 U.S.C. 154(b) by 0 days.

(21) Appl. No.: 16/357,943

(22) Filed: Mar. 19, 2019

(65) Prior Publication Data

US 2019/0214206 A1 Jul. 11, 2019

(30) Foreign Application Priority Data

Mar. 23, 2018 (CN) ..... 2018 1 0243950

(51) Int. Cl.

| | |
|---|---|
| ***H01H 33/66*** | (2006.01) |
| ***H01H 71/12*** | (2006.01) |
| ***H01F 7/02*** | (2006.01) |
| ***H01F 7/16*** | (2006.01) |

(52) U.S. Cl.

CPC ..... *H01H 33/66* (2013.01); *H01F 7/02* (2013.01); *H01F 7/1646* (2013.01); *H01H 71/12* (2013.01)

(58) Field of Classification Search

CPC ..... H01H 33/66; H01H 33/6641; H01H 33/6644; H01H 71/12; H01H 73/18; H01F 7/02; H01F 7/1646

USPC ..... 218/141, 139, 134, 129

See application file for complete search history.

(56) References Cited

U.S. PATENT DOCUMENTS

| | | | | |
|---|---|---|---|---|
| 3,071,667 A * | 1/1963 | Lee | H01H 33/664 | 218/126 |
| 4,130,781 A * | 12/1978 | Dethlefsen | H01H 33/6646 | 218/127 |
| 4,445,015 A * | 4/1984 | Zueckler | H01H 33/6644 | 218/128 |
| 4,459,446 A * | 7/1984 | Wolf | H01H 33/6646 | 218/123 |
| 5,793,008 A * | 8/1998 | Mayo | H01H 33/6641 | 218/129 |

(Continued)

*Primary Examiner* — William A Bolton

(57) ABSTRACT

The present application discloses a DC vacuum interrupter. The cup-shaped contact of the vacuum interrupter is in a transverse magnetic field. The magnetic core is placed in the contact cup. The magnetic core inside the cup of the contact works with the permanent magnets outside the vacuum interrupter to generate transverse magnetic fields in multiple directions between the contacts. While the contacts are open, the arc burns and moves rapidly along the ring shaped contacts under the transverse field along the tangent line of the contacts. While the arc moves rapidly along the ring-shaped contacts, the arc column passes the permanent magnets structure and works with the magnetic core to generate multi-polar transverse magnetic field. While the arc column makes a turn, the number of the transverse fields which are cut by the arc is same with the number of the permanent magnets set.

5 Claims, 6 Drawing Sheets

(56) References Cited

U.S. PATENT DOCUMENTS 8,274,007 B2 * 9/2012 Blalock ..... H01H 33/182
218/129

* cited by examiner

DC VACUUM INTERRUPTER WITH MULTI-POLAR TRANSVERSE PERMANENT MAGNETIC STRUCTURE

CROSS REFERENCE OF RELATED APPLICATION

This application claims priority under 35 U.S.C. 119(a-d) to CN 2018102439505, filed Mar. 23, 2018.

BACKGROUND OF THE PRESENT INVENTION

Field of Invention

The present invention relates to vacuum circuit breaker and DC vacuum interrupter field, and more particularly to DC vacuum interrupter with a multi-polar transverse permanent magnetic structure and the application thereof.

Description of Related Arts

The vacuum interrupter develops rapidly with a wide application in AC transmission and distribution system. With a development of electric car, solar power and the mature of the vacuum arc technology, how to apply the vacuum circuit breaker to DC field becomes a huge challenge and forms a huge demand.

There are two types of vacuum arc technology in the conventional vacuum circuit breaker application in AC system, which are TMF (transverse magnetic field) and AMF (axial magnetic field). The TMF induces transverse magnetic field vertical to the arc current flow in a gap between the contacts when the current passes the contacts with special structure. The arc spins rapidly on the contacts under the force, which avoid an intense burning on the contacts and enables an evenly burning of the arc on the contacts to improve the on/off capability of the switch. The AMF induces axial magnetic field parallel to the arc current flow in a gap between the contacts when the current passes the contacts with special structure. The axial magnetic field is capable of suppress a collection of arcs on the negative and positive pole under high current, which reduces a burning of the contacts and improves the on/off capability of the switch.

Research shows that the vacuum arc voltage increases significantly when a high frequency transverse filed is put on the transverse of the vertical arc current flow while the arc is burning. Conventionally, the range of the vacuum arc voltage under the force of axial magnetic contact is 20-60V and the range of vacuum arc voltage under the force of transverse magnetic contacts is 50-100V. Compared with the gas arc, especially hydrogen arc, the voltage of the electric vacuum arc is low. High arc voltage is required in DC current and special situation to turn on or off of the current. The vacuum interrupter with the conventional contact and the voltage feature of the vacuum arc are incapable of meeting the requirements. A lot of research and experiments shows that the arc voltage of the vacuum arc can be increased by 40% to 80% under a high frequency transverse magnetic field besides there are still huge space for further improvement.

To put high frequency transverse magnetic field on the vacuum arc is rather easy in a lab except for the structure is too complicate. Helmholtz coils of the transverse magnetic field are generated on one hand, the high frequency current which enables the Helmholtz coils to generate the magnetic field is required on the other hand. The method is limited in the lab and keeps from application in the industrial field due to the over-complicate structure and power circuit, though the method meets the predicted requirement of the design.

SUMMARY OF THE PRESENT INVENTION

In order to solve the problem of the conventional technology, the present invention provides a DC vacuum interrupter with multi-polar transverse permanent magnetic structure and the application thereof. The permanent magnet sets and the magnetic core inside the contact cup coordinate together based on the cup-shaped transverse magnetic field contact to solve the problem of over-complicate of the envelope structure for realizing high-frequency transverse magnetic field during the arc burning. The present invention provides a vacuum interrupter with high arc voltage under high frequency transverse magnetic field, which has a good perspective to be applied in industrial field and is able to be applied in high arc voltage circuit. The present invention is based on research and experiments.

In order to achieve the goal, the present invention adopts the below technical solution:

A DC vacuum interrupter with a permanent magnetic structure, comprises: a ceramic envelope (122), a permanent magnetic structure 201 at a fixed side outside of the ceramic envelope (122), a permanent magnetic structure 202 at a moving side outside of the ceramic envelope (122), a multi-polar magnetic core structure 103 at the fixed side inside of the ceramic envelope (122), a multi-polar magnetic core structure (106) at the moving side inside of the ceramic envelope (122), a cup-shaped transverse magnetic contact (102) at the fixed side and a cup-shaped transverse magnetic contact (107) at the moving side, wherein a multi-polar transverse magnetic field is generated in a gap between the cup-shaped transverse magnetic contact (102) at the fixed side and the cup-shaped transverse magnetic contact (107) at the moving side by the permanent magnetic structure (201) at the fixed side and the permanent magnetic structure at the moving side and the multi-polar magnetic core structure (103) at the fixed side and the multi-polar magnetic core structure 106 at the moving side; when an arc goes around a ring contact material (104) at the fixed side and a ring contact material (105) at the moving side in the gap, the arc cuts magnetic field lines of a transverse magnetic field generated by the permanent magnetic structure (201) and the permanent magnetic structure (202) and the multi-polar magnetic core structure (103) and the multi-polar magnetic core structure (106); an arc column moves rapidly between the gap under a magnetic force generated by the cup-shaped transverse magnetic contact (102) at the fixed side and the cup-shaped transverse magnetic contact (107) at the moving side during a high current arc-melting procedure; thus the transverse magnetic field generated by the permanent magnetic structure (201) at the fixed side and the permanent magnetic structure (202) at the moving side and the multi-polar magnetic core structure (103) at the fixed side and the multi-polar magnetic core structure (106) at the moving side acts on the arc for multiple times during the high current arc-melting procedure. The excitation system of the permanent magnet of the vacuum interrupter acts similar to the high frequency transverse magnetic field, which increases the arc voltage significantly.

Research shows that the vacuum arc goes around the ring contact in 2 ms while the arc burning of the high current cup-shaped transverse magnetic field contact. If the transverse permanent magnets set has six poles, the vacuum arc passes each of the poles in 0.33 ms, which equals to a 3000 Hz transverse magnetic field acting on the vacuum arc. Considering the spinning speed of the arc column during the arc burning is in waves, the frequency of the transverse magnetic field of the vacuum arc is equivalent to above 1000 Hz. Thus, the present invention acts similar to the high frequency transverse magnetic field generated by the Helmholtz coil outside of the vacuum interrupter under the coordination of the permanent magnet set and the magnetic core inside the contact cup.

The detailed design is as follow:

The DC vacuum interrupter comprises a fixed side structure and a moving side structure;

wherein the fixed side structure further comprises a conducting rod (101) at the fixed side, an end cap (121) at the fixed side which is welded on a top of the conducting rod (101); a ceramic envelope (122) is welded on edges of the end cap (121); the cup-shaped transverse magnetic contact (102) at the fixed side is welded on the bottom of the conducting rod (101); the ring contact material (104) at the fixed side is welded on a bottom of the cup-shaped transverse magnetic contact (102); the multi-polar magnetic core structure (103) is welded on the bottom of the ring contact material (104) at the fixed side; a welding surface of the ring contact material (104) is more protruding than an outer surface of the multi-polar magnetic core structure (103); the permanent magnetic structure (201) is placed around the ceramic envelope (122) within a height of the multi-polar magnetic core structure 103; the permanent magnetic structure (201) further comprises a permanent magnetic supporting ring (109) and multiple permanent magnetic sets (110) which are inserted evenly around the permanent magnetic supporting ring (109);

wherein the moving side structure further comprises a conducting rod (108) at the moving side; the cup-shaped transverse magnetic contact (107) is welded on the top of the conducting rod 108 at the moving side; the ring contact material (105) at the moving side is welded on the top of the cup-shaped transverse magnetic contact (107); the multi-polar magnetic core structure (106) at the moving side is welded on the bottom of the cup-shaped transverse magnetic contact (107); a welding surface of the ring contact material (105) is more protruding than an outer surface of the multi-polar magnetic core structure (106); the permanent magnetic structure (202) is placed around the ceramic envelope (122); the permanent magnetic structure (202) further comprises a permanent magnetic supporting ring (112) and multiple permanent magnetic sets (111) which are inserted evenly around the permanent magnetic supporting ring (112); a vacuum bellow connector (123) is welded on the bottom of the conducting rod (108); a vacuum bellow (124) is welded on the bottom of the vacuum bellow connector (123); an moving side end cap (125) is welded on the bottom of the vacuum bellow (124);

poles of the multi-polar magnetic core structure (103) is the same as permanent magnetic poles of the multiple permanent magnetic sets (110) in the permanent magnetic structure (201); the number of the poles is not less than two; the angle of each pole of the multi-polar magnetic core structure (103) is same with the angle of each permanent magnet of the permanent magnetic structure (201), a north pole and a south pole of each permanent magnet in the multiple permanent magnetic sets (110) of the permanent magnetic structure (201) are in a same direction with a north pole and a south pole of the multi-polar magnetic core structure (103); the north pole or the south pole of each permanent magnet in the multiple permanent magnetic sets (110) is direct to the vacuum interrupter; the north pole and the south pole of neighboring permanent magnets in the multiple permanent magnetic sets (110) are in a same or different direction; a height of the permanent magnetic structure (201) is same with the height of the multi-polar magnetic core structure (103), or different with the height of the multi-polar magnetic core structure (103) according to needs of magnetic fields control.

poles of the multi-polar magnetic core structure (106) is the same as permanent magnetic poles of the multiple permanent magnetic sets (111) in the permanent magnetic structure (202); the number of poles is not less than two; the angle of each pole of the multi-polar magnetic core structure (106) is same with the angle of each permanent magnet of the permanent magnetic structure (202), a north pole and a south pole of each permanent magnet in the multiple permanent magnetic sets (111) of the permanent magnetic structure (202) are in a same direction with a north pole and a south pole of the multi-polar magnetic core structure (106); the north pole or the south pole of each of the permanent magnets in the multiple permanent magnetic sets (111) is direct to the vacuum interrupter; the north pole and the south pole of neighboring permanent magnets in the multiple permanent magnetic sets (111) are in a same or different direction; a height of the permanent magnetic structure (202) is same with the height of the multi-polar magnetic core structure (106), or different with the height of the multi-polar magnetic core structure 106 according to the needs of magnetic fields control.

In the permanent magnetic structure (201) and the permanent magnetic structure (202), a distance of end surfaces of the permanent magnet in the permanent magnetic sets 111 and the permanent magnetic sets (110) to corresponding end surfaces of the multi-polar magnetic core structure (103) and the multi-polar magnetic core structure (106) is less than three times of a length of the permanent magnets respectively.

The permanent magnetic structure (201) and the permanent magnetic structure 201 are independent at fixed side and moving side or close together as a whole with corresponding a permanent magnet supporting ring and a permanent magnet set.

A vacuum circuit breaker comprises the DC vacuum interrupter described above.

A DC vacuum interrupter with a multi-polar transverse permanent magnetic structure, comprises a ceramic envelope (122), a permanent magnetic structure (201) at a fixed side outside of the ceramic envelope (122), a permanent magnetic structure 202 at a moving side outside of the ceramic envelope (122), a multi-polar magnetic core structure (103) at the fixed side inside of the ceramic envelope (122), a multi-polar magnetic core structure (106) at the moving side inside of the ceramic envelope (122), a cup-shaped transverse magnetic contact (102) at the fixed side and a cup-shaped transverse magnetic contact (107) at the moving side, wherein a multi-polar transverse magnetic field is generated in a gap between the cup-shaped transverse magnetic contact (102) at the fixed side and the cup-shaped transverse magnetic contact (107) at the moving side by the permanent magnetic structure (201) at the fixed side and the permanent magnetic structure at the moving side and the multi-polar magnetic core structure (103) at the fixed side and the multi-polar magnetic core structure (106) at the moving side; when an arc goes around a ring contact material (104) at the fixed side and a ring contact material (105) at the moving side in the gap, the arc cuts magnetic field lines of a transverse magnetic field generated by the permanent magnetic structure (201) and the permanent magnetic structure (202) and the multi-polar magnetic core structure (103) and the multi-polar magnetic core structure (106); an arc column moves rapidly between the gap under a magnetic force generated by the cup-shaped transverse magnetic contact (102) at the fixed side and the cup-shaped transverse magnetic contact (107) at the moving side during a high current arc-melting procedure; thus the transverse magnetic field generated by the permanent magnetic structure (201) at the fixed side and the permanent magnetic structure (202) at the moving side and the multi-polar magnetic core structure (103) at the fixed side and the multi-polar magnetic core structure (106) at the moving side acts on the arc for multiple times during the high current arc-melting procedure. The excitation system of the permanent magnet of the vacuum interrupter acts similar to the high frequency transverse magnetic field, which increases the arc voltage significantly. The present invention achieves the goal of DC breaking and is able to be applied in situation needs high arc voltage. The present invention takes the effects of the high frequency transverse magnetic field on the vacuum arc voltage into account and takes full advantages of the high speed circle movement of the vacuum arc during arc burning. The present invention further brings about a delicate magnetic circuit design of the transverse magnetic field and successfully realizes a multi-polar design of the transverse magnetic field by the multi-polar permanent magnets. The present invention increases the vacuum arc voltage and promotes the applications in DC on/off in the vacuum circuit breaker which adopts the vacuum interrupter.

The present invention has the following advantages comparing with the conventional technology.

1) High frequency transverse magnetic field is put on the vacuum arc. The present invention takes advantage of the arc turning around rapidly on the surface of the contact and successfully improves arc voltage of the vacuum interrupter. The vacuum breaker in DC circuit adopts the vacuum interrupter in the present invention is possible.

2) The present invention designs magnetic circuit of transverse magnetic and realizes multi-polar transverse magnetic field through multi-polar permanent magnets. The present invention does not require complicate Helmholtz coils and complicated power supply system with excitation current.

3) The present invention is simple in structure with low fault rate and is able to promote a wide application of the vacuum interrupter in industrial filed.

4) The strength of transverse magnetic field between the gap of the conventional contacts rapidly attenuates with the widening of the gap, which limit the application of the contacts with transverse magnetic field in high voltage situations.

The present invention generates a rather strong magnetic field between the gap of the contacts by the permanent magnets structure, which is able to be applied the vacuum interrupter in a circuit with higher voltage.

DETAILED DESCRIPTION OF THE PREFERRED EMBODIMENT

Figure 1:
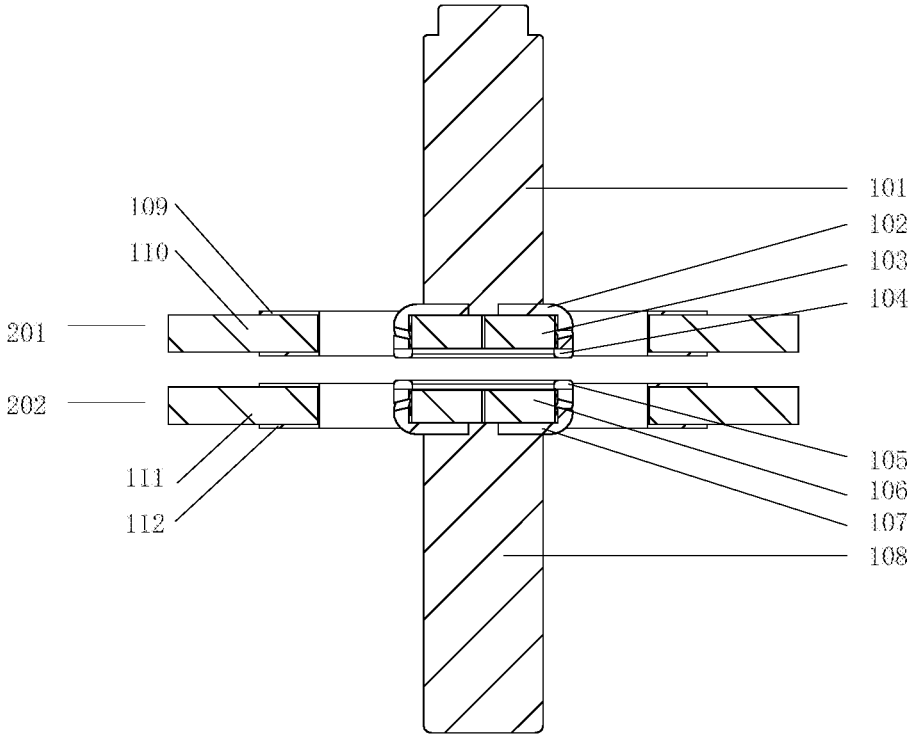
FIG. 1 is a cross-section view along the axial of a DC vacuum interrupter contacts and a permanent magnets excitation structure of a four-polar transverse permanent magnets structure of the present invention of a multi-polar DC vacuum interrupter with a transverse permanent magnets structure.

Referring to the drawings, the present invention is described in detail with the embodiments.

Figure 2:
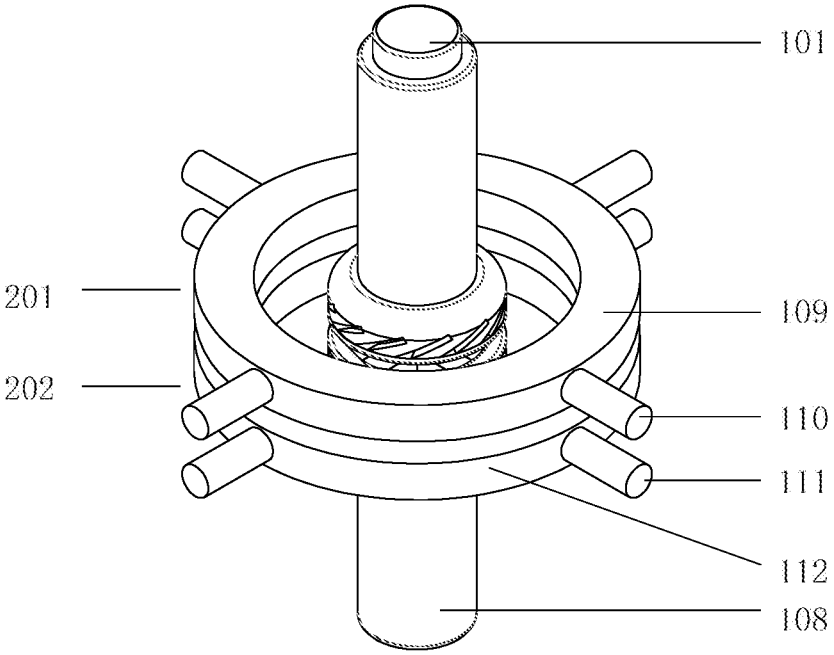
FIG. 2 is a side view the DC vacuum interrupter contacts and a permanent magnets excitation structure of the four-polar transverse permanent magnets structure of the present invention of a multi-polar DC vacuum interrupter with the transverse permanent magnets structure.

FIG. 1 and FIG. 2 are a cross-section view along the axial and the side view of a DC vacuum interrupter contacts and a permanent magnetic excitation structure of a four-polar transverse permanent magnetic structure of the present invention of a multi-polar DC vacuum interrupter with a transverse permanent magnetic structure. As shown in the FIG. 1 and FIG. 2 the fixed side structure further comprises a conducting rod 101, wherein the cup-shaped transverse magnetic contact 102 at the fixed side is welded on the bottom of the conducting rod 101; the ring contact material 104 at the fixed side is welded on the bottom of the cup-shaped transverse magnetic contact 102; the multi-polar magnetic core structure 103 is welded on the inner bottom of the cup-shaped transverse magnetic contact 102 of the fixed side; the welding surface of the ring contact material 104 is more protruding than an outer surface of the multi-polar magnetic core structure 103; the permanent magnetic structure 201 is placed around the ceramic shielding 122 within a height of the multi-polar magnetic core structure 103; the permanent magnetic structure 201 further comprises a permanent magnetic supporting ring 109 and multiple permanent magnetic sets 110.

As shown in FIG. 1 and FIG. 2, the moving side structure further comprises a conducting rod 108 at the moving side; the cup-shaped transverse magnetic contact 107 is welded on a top of the conducting rod 108 at the moving side; the ring contact material 105 at the moving side is welded on a top of the cup-shaped transverse magnetic contact 107; the multi-polar magnetic core structure 106 at the moving side is welded on the inner bottom of the cup-shaped transverse magnetic contact 107; the welding surface of the ring contact material 105 is more protruding than an outer surface of the multi-polar magnetic core structure 106; the permanent magnetic structure 202 is placed around the ceramic shielding 122; the permanent magnetic structure 202 further comprises a permanent magnetic supporting ring 112 and multiple permanent magnetic sets 111.

The fixed side permanent magnet set 110 and the moving side permanent magnet set 111 comprise four permanent magnets respectively which are evenly distributed along the circle of the permanent magnetic supporting ring 109 and the permanent magnetic supporting ring 112.

Figure 3A:
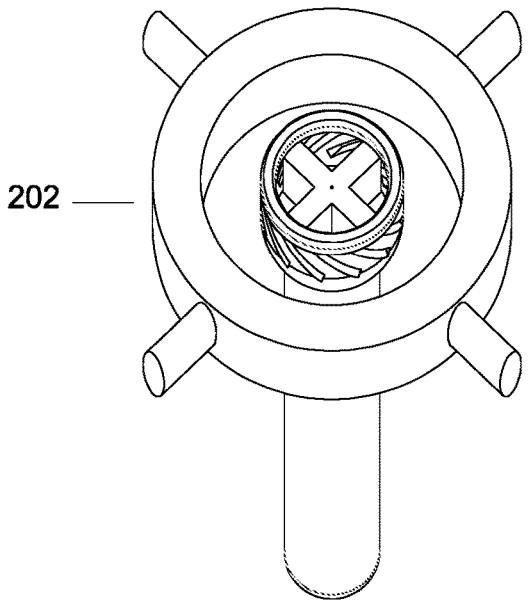
FIGS. 3*a* and 3*b* are relative position and radial section view of the DC on/off vacuum interrupter contacts and a permanent magnets excitation structure of the four-polar transverse permanent magnets structure of the present invention of a multi-polar DC vacuum interrupter with the transverse permanent magnets structure.
Figure 3B:
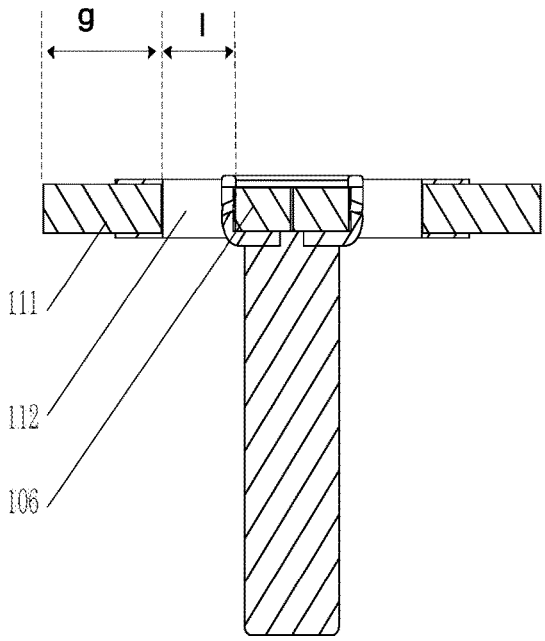

FIGS. 3*a* and 3*b* are relative position and radial section view of the DC vacuum interrupter contacts and a permanent magnets excitation structure of the four-polar transverse permanent magnets structure of the present invention of a multi-polar DC vacuum interrupter with the transverse permanent magnetic structure. The moving side permanent magnet set 111 comprises four permanent magnets which are evenly distributed along the circle of the permanent magnetic supporting ring 112 and point to the four poles of the multi-polar magnetic core structure 106 inside the cup-shaped transverse magnetic contact 107. The distance between the end surface of the of the moving side permanent magnet set 111 to the surface of corresponding pole of multi-polar magnetic core structure 106 is l; the length of the permanent magnet is g, l varied in a range of 0 to 3 g.

Figure 4A:
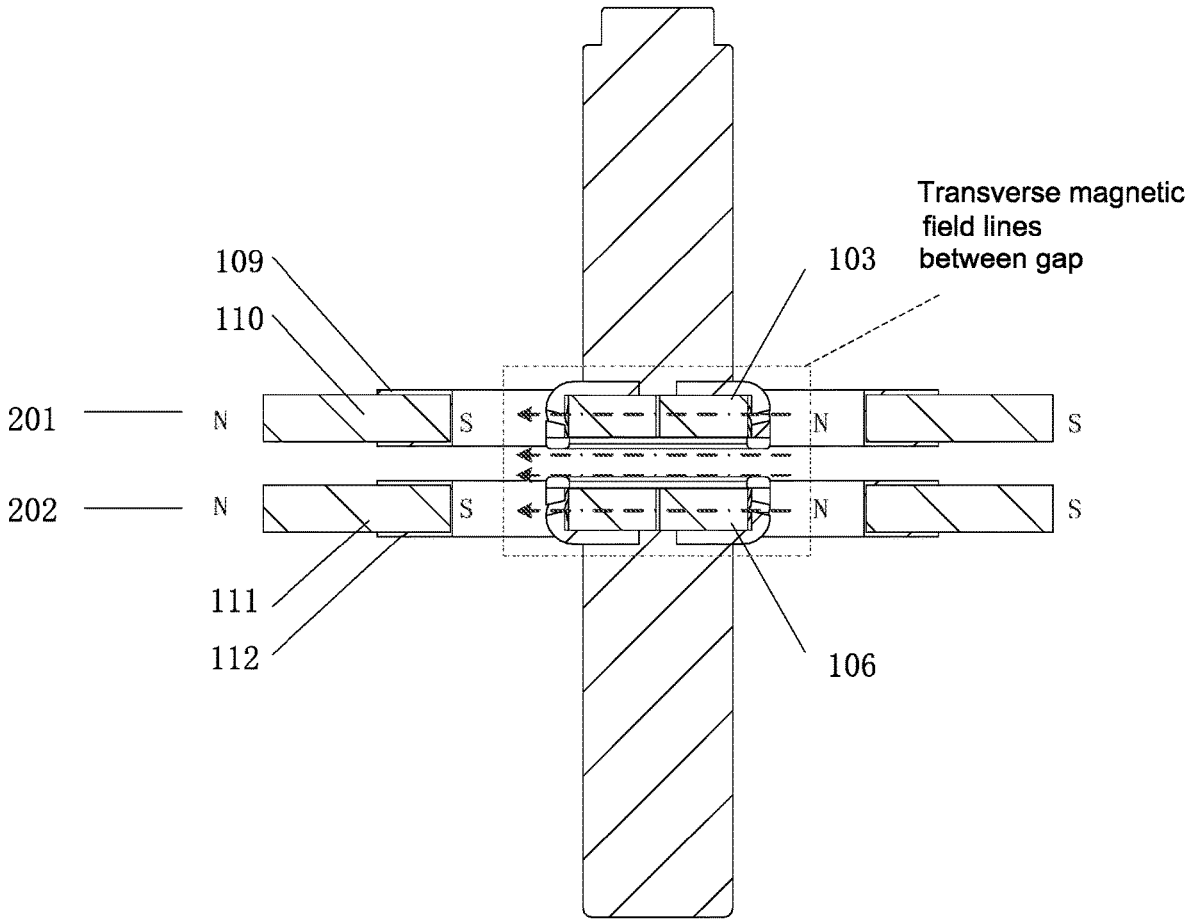
FIG. 4*a* is the relative position of the N-pole and the S-pole of one of the permanent magnetic set of the DC vacuum interrupter contacts and a permanent magnets excitation structure of the four-polar transverse permanent magnets structure of the present invention of a multi-polar DC vacuum interrupter with the transverse permanent magnets structure.
Figure 4B:
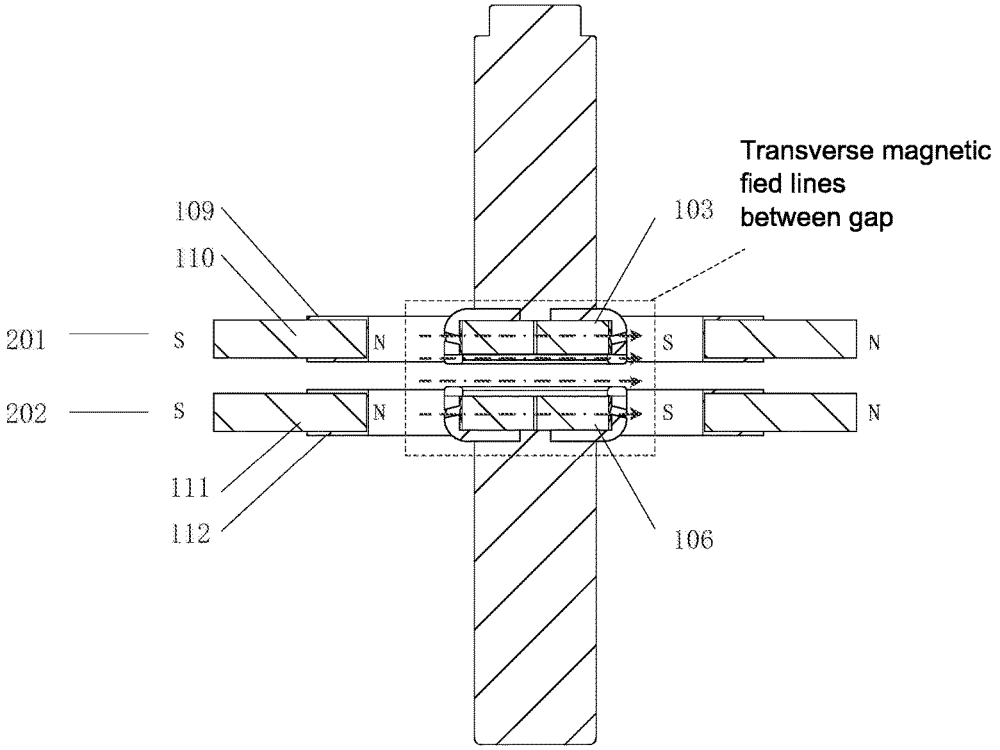
FIG. 4*b* is the relative position of another set of the permanent magnet.

FIGS. 4*a* and 4*b* are the relative position of the N-pole and the S-pole of one of the permanent magnetic set of the DC vacuum interrupter contacts and a permanent magnetic excitation structure of the four-polar transverse permanent magnetic structure of the present invention of a multi-polar DC vacuum interrupter with the transverse permanent magnetic structure. As shown in FIGS. 4*a* and 4*b*, the direction of the N-polar of S-polar is same with the N-polar and S-polar with a 180 degree difference in the permanent magnetic structure 201 and permanent magnetic structure 202.

Figure 5A:
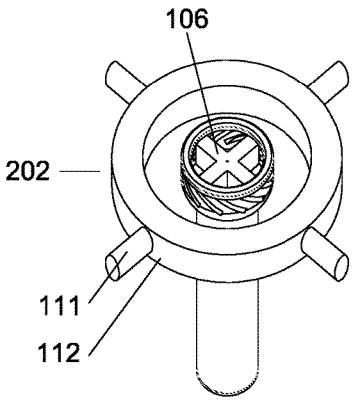
FIGS. 5*a*, 5*b* and 5*c* are the perspective view of the relative position of the transverse permanent magnetic structure and the contacts of four-polar, six-polar and eight-polar DC vacuum interrupter of the present invention of a multi-polar DC vacuum interrupter with the transverse permanent magnets structure.
Figure 5B:
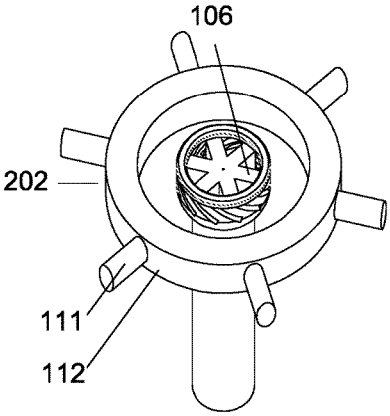
Figure 5C:
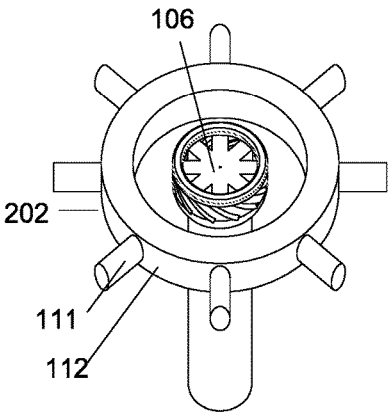

FIGS. 5*a*, 5*b* and 5*c* are the perspective view of the relative position of the transverse permanent magnetic structure and the contacts of four-polar, six-polar and eight-polar DC vacuum interrupter of the present invention of a multi-polar DC vacuum interrupter with the transverse permanent magnetic structure. The poles of the multi-polar magnetic core structure 106 is same with the poles of the permanent magnet in the permanent magnetic structure 202. The angle of the poles of the multi-polar magnetic core structure 106 is same with the poles of the permanent magnet in the permanent magnetic structure 202.

Figure 6A:
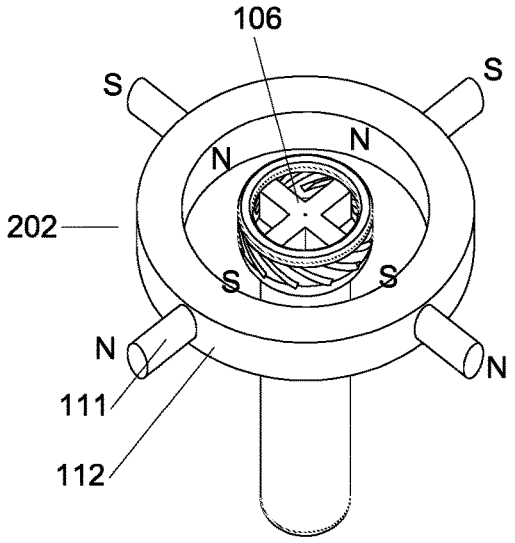
FIGS. 6*a* and 6*b* are the relative position of the N-pole and S-pole of the transverse magnets of the four-polar and six-polar of the present invention of a multi-polar DC vacuum interrupter with the transverse permanent magnets structure.
Figure 6B:
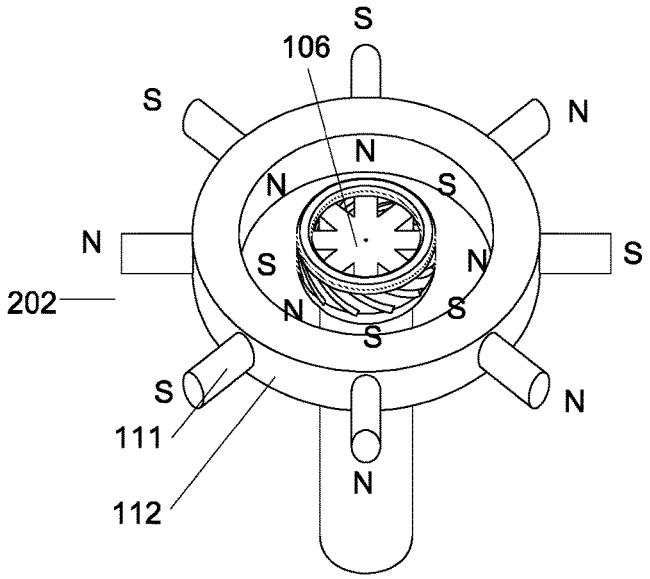

FIGS. 6*a* and 6*b* is the relative position of the N-pole and S-pole of the transverse magnets of the four-polar and six-polar of the present invention of a multi-polar DC vacuum interrupter with the transverse permanent magnetic structure. The direction of the N-polar of S-polar of the permanent magnets is same with the N-polar and S-polar with a 180 degree difference in the permanent magnet set 111. Both the N-polar and S-polar of the permanent magnets in the permanent magnet set 111 are allowed to point to the vacuum interrupter side. The neighboring N-polar and S-polar are capable to point to the same or different direction.

Figure 7:
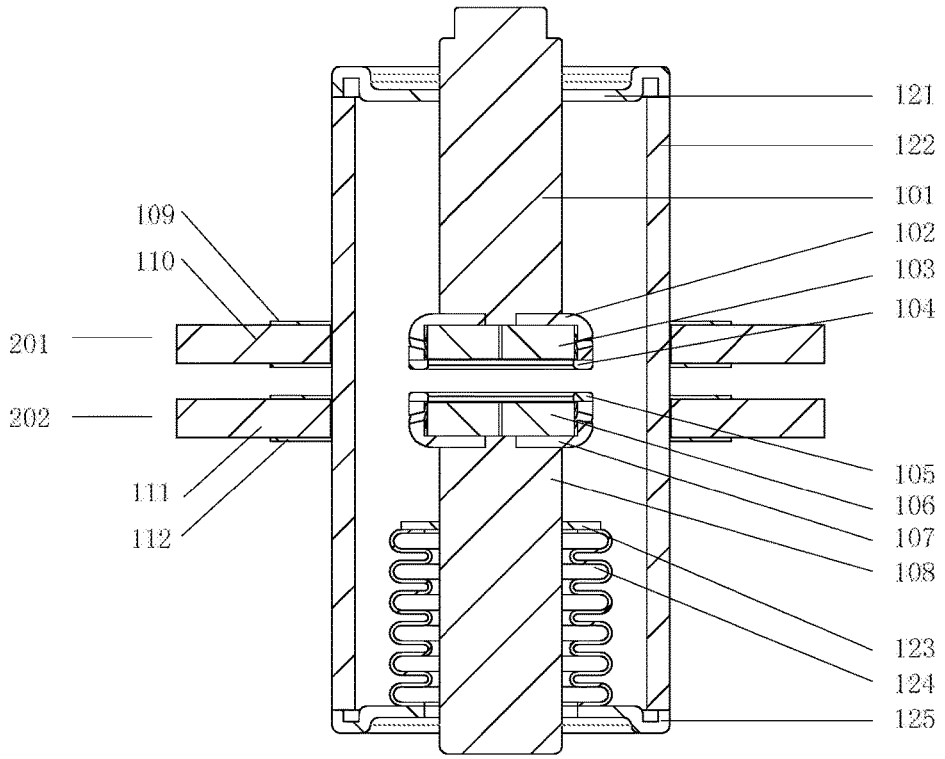
FIG. 7 is a section-view of the four-polar transverse permanent magnet structure DC vacuum interrupter of the present invention of a multi-polar DC vacuum interrupter with the transverse permanent magnets structure.
Figure 8:
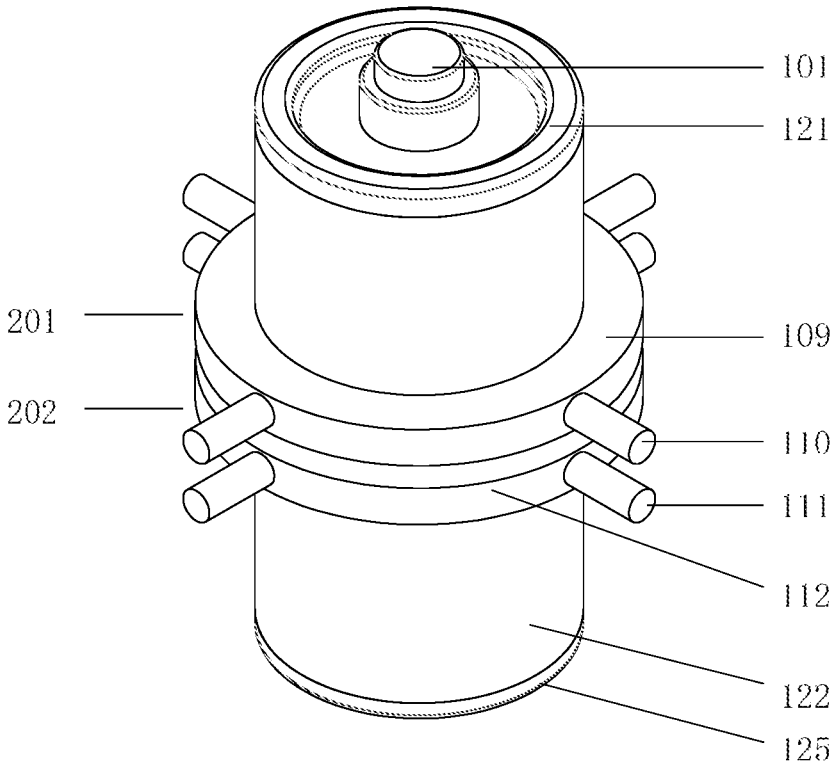
FIG. 8 is a side-view of the four-polar transverse permanent magnet structure DC vacuum interrupter of the present invention of a multi-polar DC vacuum interrupter with the transverse permanent magnets structure.

FIG. 7 is a section-view of the four-polar transverse permanent magnetic structure DC vacuum interrupter of the present invention of a multi-polar DC vacuum interrupter with the transverse permanent magnetic structure. As shown in FIG. 7, the fixed side structure further comprises a conducting rod 101 at the fixed side, the cup-shaped transverse magnetic contact 102 at the fixed side is welded on the bottom of the conducting rod 101; the ring contact material 104 at the fixed side is welded on the bottom of the cup-shaped transverse magnetic contact 102; the multi-polar magnetic core structure 103 is welded on the inner bottom of the cup-shaped transverse magnetic contact 102 at the fixed side; a welding surface of the ring contact material 104 is more protruding than an outer surface of the multi-polar magnetic core structure 103; the permanent magnetic structure 201 is placed around the ceramic shielding 122 within a height of the multi-polar magnetic core structure 103; the permanent magnetic structure 201 further comprises a permanent magnetic supporting ring 109 and multiple permanent magnetic sets 110. An end cap 121 at the fixed side is welded on the top of the conducting rod 101. A ceramic shielding 122 is welded on the edge of the end cap 121. The moving side structure further comprises a conducting rod 108 at the moving side; the cup-shaped transverse magnetic contact 107 is welded on a top of the conducting rod 108 at the moving side; the ring contact material 105 at the moving side is welded on the top of the cup-shaped transverse magnetic contact 107; the multi-polar magnetic core structure 106 at the moving side is welded on the inner bottom of the cup-shaped transverse magnetic contact 107; a welding surface of the ring contact material 105 is more protruding than an outer surface of the multi-polar magnetic core structure 106; the permanent magnetic structure 202 is placed around the ceramic shielding 122; the permanent magnetic structure 202 further comprises a permanent magnetic supporting ring 112 and multiple permanent magnetic sets 111; a vacuum bellow connector 123 is welded on the bottom of the conducting rod 108; a vacuum bellow 124 is welded on the bottom of the vacuum bellow connector 123; an moving side end cap 125 is welded on a bottom of the vacuum bellow 124;

FIG. 8 is a side-view of the four-polar transverse permanent magnetic structure DC vacuum interrupter of the present invention of a multi-polar DC vacuum interrupter with the transverse permanent magnetic structure. As shown in the FIG. 8, there are two sets of permanent magnetic structure in the gap between the contacts outside of the ceramic shielding, which are the permanent magnetic structure 201 and the permanent magnetic structure 202. The permanent magnet set of the permanent magnetic structure 201 comprises four permanent magnets which are evenly distributed along the circle of the permanent magnetic supporting ring 109. The permanent magnetic structure 202 is similar to the permanent magnetic structure 201. The difference in the height of the permanent magnetic structure 201 and the permanent magnetic structure 202 with the height of the multi-polar magnetic core structure 103 and the multi-polar magnetic core structure 106 is less than three times of the gap between the contacts.

One skilled in the art will understand that the embodiment of the present invention as shown in the drawings and described above is exemplary only and not intended to be limited. Any modification and alteration of the DC vacuum interrupter with multi-polar transverse permanent magnetic structure and the applications thereof are within the protection range of the present invention.

What is claimed is:

1. A DC (Direct Current) vacuum interrupter with a multi-polar transverse permanent magnetic structure, comprising: a ceramic envelope (122), a first permanent magnetic structure (201) at a fixed side outside of the ceramic envelope (122), a second permanent magnetic structure (202) at a moving side outside of the ceramic envelope (122), a first multi-polar magnetic core structure (103) at the fixed side inside of the ceramic envelope (122), a second multi-polar magnetic core structure (106) at the moving side inside of the ceramic envelope (122), a first cup-shaped transverse magnetic contact (102) at the fixed side and a second cup-shaped transverse magnetic contact (107) at the moving side, wherein a multi-polar transverse magnetic field is generated in a gap between the first cup-shaped transverse magnetic contact (102) at the fixed side and the second cup-shaped transverse magnetic contact (107) at the moving side by the first permanent magnetic structure (201) at the fixed side and the multi-polar transverse permanent magnetic structure at the moving side and the first multi-polar magnetic core structure (103) at the fixed side and the second multi-polar magnetic core structure (106) at the moving side; when an arc goes around a first ring contact material (104) at the fixed side and a second ring contact material (105) at the moving side in the gap, the arc cuts magnetic field lines of a transverse magnetic field generated by the first permanent magnetic structure (201) and the second permanent magnetic structure (202) and the first multi-polar magnetic core structure (103) and the second multi-polar magnetic core structure (106); an arc column moves rapidly between the gap under a magnetic force generated by the first cup-shaped transverse magnetic contact (102) at the fixed side and the second cup-shaped transverse magnetic contact (107) at the moving side during a high current arc-melting procedure; thus the transverse magnetic field generated by the first permanent magnetic structure (201) at the fixed side and the second permanent magnetic structure (202) at the moving side and the first multi-polar magnetic core structure (103) at the fixed side and the second multi-polar magnetic core structure (106) at the moving side acts on the arc for multiple times during the high current arc-melting procedure.

2. The DC vacuum interrupter, as recited in claim 1, further comprising a fixed side structure and a moving side structure;

wherein the fixed side structure further comprises a first conducting rod (101) at the fixed side, an end cap (121) at the fixed side which is welded on a top of the conducting rod (101); the ceramic shielding (122) is welded on edges of the end cap (121); the first cup-shaped transverse magnetic contact (102) at the fixed side is welded on a bottom of the first conducting rod (101); the first ring contact material (104) at the fixed side is welded on a bottom of the first cup-shaped transverse magnetic contact (102); the first multi-polar magnetic core structure (103) is welded on an inner bottom of the first ring contact material (104) at the fixed side; a welding surface of the first ring contact material (104) is more protruding than a surface of the first multi-polar magnetic core structure (103); the first permanent magnetic structure (201) is placed around the ceramic envelope (122) within a height of the first multi-polar magnetic core structure (103); the first permanent magnetic structure (201) further comprises a first permanent magnetic supporting ring (109) and a first multiple permanent magnetic sets (110) which are inserted evenly around the permanent magnetic supporting ring (109);

wherein the moving side structure further comprises a second conducting rod (108) at the moving side; the second cup-shaped transverse magnetic contact (107) is welded on a top of the second conducting rod (108) at the moving side; the second ring contact material (105) at the moving side is welded on a top of the second cup-shaped transverse magnetic contact (107); the second multi-polar magnetic core structure (106) at the moving side is welded on an inner bottom of the second cup-shaped transverse magnetic contact (107); a welding surface of the second ring contact material (105) is more protruding than a surface of the second multi-polar magnetic core structure (106); the second permanent magnetic structure (202) is placed around the ceramic shielding (122); the second permanent magnetic structure (202) further comprises a second permanent magnetic supporting ring (112) and a second multiple permanent magnetic sets (111) which are inserted evenly around the second permanent magnetic supporting ring (112); a vacuum bellow connector (123) is welded on a bottom of the second conducting rod (108); a vacuum bellow (124) is welded on a bottom of the vacuum bellow connector (123); a moving side end cap (125) is welded on a bottom of the vacuum bellow (124);

poles of the first multi-polar magnetic core structure (103) is same with a first batch of permanent magnetic poles of the first multiple permanent magnetic sets (110) in the first permanent magnetic structure (201); a number of the poles is not less than two; an angle of each pole of the first multi-polar magnetic core structure (103) is same with an angle of each permanent magnets of the first permanent magnetic structure (201), a north pole and a south pole of each of the first permanent magnets in the first multiple permanent magnetic sets (110) of the first permanent magnetic structure (201) are in a same direction with a north pole and a south pole of the first multi-polar magnetic core structure (103); the north pole or the south pole of each of permanent magnets in the first multiple permanent magnetic sets (110) is direct to the vacuum interrupter; the north pole and the south pole of neighboring permanent magnets in the first multiple permanent magnetic sets (110) are in a same or different direction; a height of the first permanent magnetic structure (201) is same with the height of the first multi-polar magnetic core structure (103), or different with the height of the first multi-polar magnetic core structure (103) according to needs of magnetic fields control;

poles of the second multi-polar magnetic core structure (106) is same with a second batch of permanent magnetic poles of the second multiple permanent magnetic sets (111) in the second permanent magnetic structure (202); a number of the poles is not less than two; an angle of each of the poles of the second multi-polar magnetic core structure (106) is same with an angle of each of permanent magnets of the second permanent magnetic structure (202), a north pole and a south pole of each of the permanent magnets in the second multiple permanent magnetic sets (111) of the second permanent magnetic structure (202) are in a same direction with a north pole and a south pole of the second multi-polar magnetic core structure (106); the north pole or the south pole of each of the permanent magnets in the second multiple permanent magnetic sets (111) is direct to the vacuum interrupter; the north pole and the south pole of neighboring permanent magnets in the second multiple permanent magnetic sets (111) are in a same or a different direction; a height of the second permanent magnetic structure (202) is same with the height of the second multi-polar magnetic core structure (106), or different with the height of the second multi-polar magnetic core structure (106) according to the needs of magnetic fields control.

3. The DC vacuum interrupter as recited in claim 2, wherein a distance of end surfaces of the permanent magnets in the second multiple permanent magnetic sets (111) and the first multiple permanent magnetic sets (110) to corresponding end surfaces of the first multi-polar magnetic core structure (103) and the second multi-polar magnetic core structure (106) is less than three times of a length of the permanent magnets respectively.

4. The DC vacuum interrupter as recited in claim 1, wherein the first permanent magnetic structure (201) and the second permanent magnetic structure (202) are independent or close together as a whole with corresponding a permanent magnet supporting ring and a permanent magnet set.

5. The vacuum circuit breaker, wherein a vacuum circuit breaker, comprises a DC vacuum interrupter described in claim 1.

* * * * *